United States Patent [19]

Tizzi

[11] Patent Number: 4,679,391

[45] Date of Patent: Jul. 14, 1987

[54] METHOD OF MANUFACTURING JEWELRY CHAINS FROM DECORATED HELICOID MEMBERS AND/OR LINKS

[76] Inventor: Valtiero Tizzi, Via Clementini 2, 47037 Rimini (Forlì), Italy

[21] Appl. No.: 782,040

[22] Filed: Sep. 30, 1985

[30] Foreign Application Priority Data

Nov. 14, 1984 [IT] Italy ..... 3623 A/84

[51] Int. Cl.[4] ..... B21L 7/00; B21F 3/04

[52] U.S. Cl. ..... 59/20; 59/35.1; 72/137; 72/142

[58] Field of Search ..... 29/160.6; 59/16, 17, 59/20, 35.1, 80; 72/130, 137, 142

[56] References Cited

U.S. PATENT DOCUMENTS 4,275,555 6/1981 Bichi ..... 59/17 X
4,493,183 1/1985 Bucefari et al. ..... 59/16

FOREIGN PATENT DOCUMENTS 2029944 10/1970 France ..... 59/35.1
280022 11/1930 Italy ..... 59/17
1534 9/1916 Netherlands ..... 59/16

*Primary Examiner*—E. Michael Combs
*Attorney, Agent, or Firm*—Birch, Stewart, Kolasch & Birch

[57] ABSTRACT

The method disclosed for automatic decoration of helicoid members and/or links of whatever cross section from which to fashion chain-type articles of jewelry comprises not only conventional steps, but also the additional steps of milling the wire to be crafted, winding it around a former with splines that grip the milled surface, and decorating it while still wound around the former, following which, and before formation of the links, the wire can be shaped to match the cross section of the end part of the splined former. Such a method is carried into effect with apparatus featuring a splined former capable of movement within a spiral sleeve provided with windows through which tools used for crafting are afforded access to the wire, and a mechanism which alters the geometry of the initial rounded section of the helicoid so as to produce any one of a variety of shapes.

5 Claims, 10 Drawing Figures

FIG1
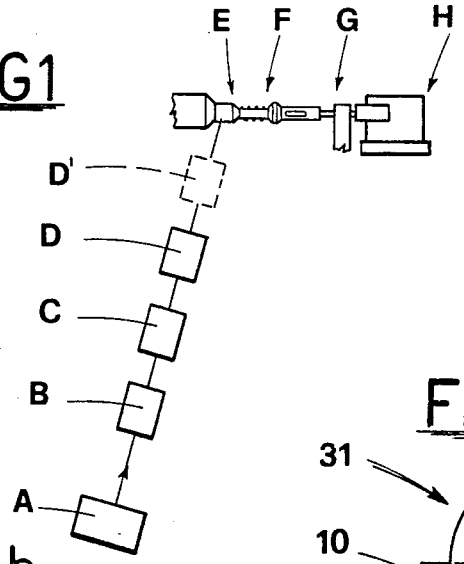
FIG4
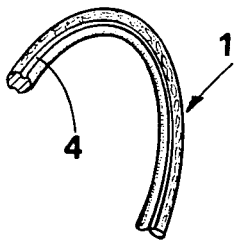
FIG1a
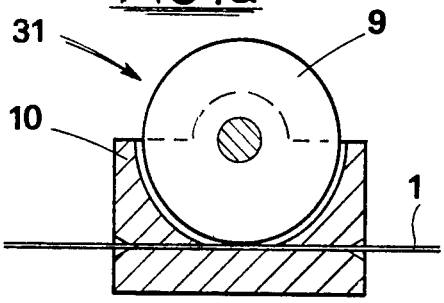
FIG1b
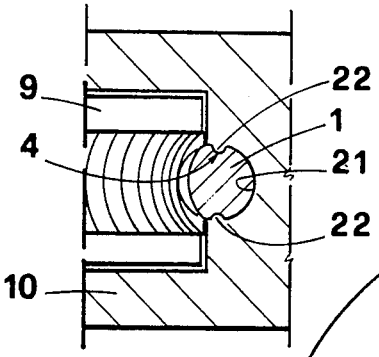
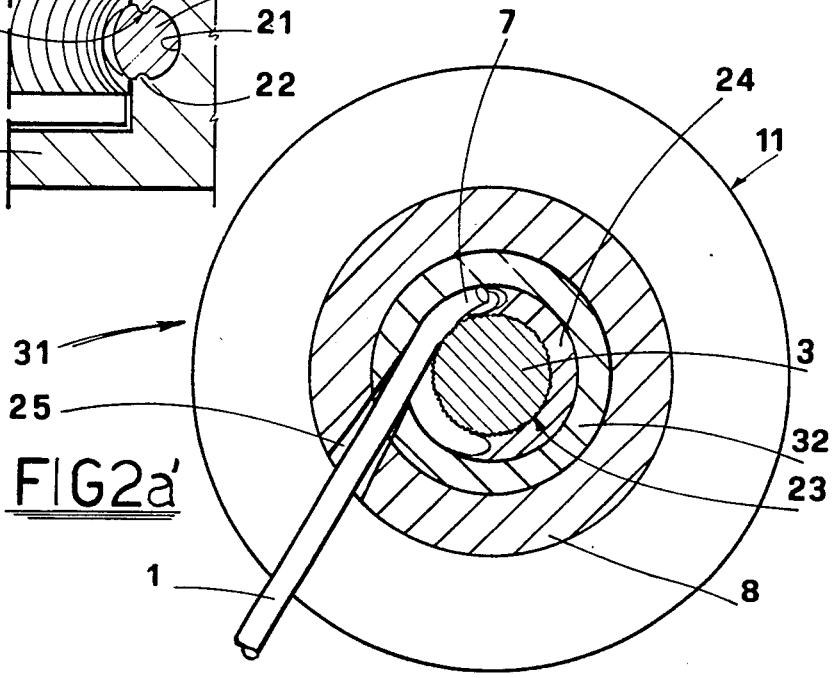
FIG2a'

27
30
28
31
26
19
20
24
1
11
8
3
7
6
5
β
2
23
29
12
17
18

METHOD OF MANUFACTURING JEWELRY CHAINS FROM DECORATED HELICOID MEMBERS AND/OR LINKS

BACKGROUND OF THE INVENTION

The invention relates to a method and to apparatus for the automatic decoration of helicoid members and/or links from which to fashion articles of jewelry in precious metal, and articles of costume jewelry.

A person skilled in the art will know that in crafting chains, the option exists either of decorating a wire prior to forming the links, or of forming links which are then decorated.

Whilst the first option may turn out to be more productive in certain cases, the action of shaping the wire by bending it around a former (of quite small diameter, in some instances) occasions stretching of the molecules farthest from the former, giving rise to a so-called 'orange-peel' effect.

This drawback can be avoided by adopting the second option and indeed the prior embraces machines which, utilizing appropriate tools, are designed to cart single links obtained from the turns of a helicoid wound around a rotatable former; such a former will be invested with back-and-forth movement through an axial path, and cannot be perfectly rounded.

It becomes necessary, therefore, to feed the helicoid thus formed by and between an outer support and an internal former, in such a way that the tools can grip the cut links one at a time and craft them automatically on a mass production basis, connecting them one by one to the growing chain.

The dimensions of the former must therefore remain within certain strict limits as dictated by an external support which, besides supporting the former at one end, must allow the wire, wound under tension around the former (which, not being round, does not breast completely with the wire), to run out of the other end through a fixed spiral sleeve of dimensions such as will accommodate the former together with the wire wound around it.

The helicoid wound from the wire must in fact be created by these components such that with each turn indexed, a link is fed forward to be crafted by automated steps of the process.

For the helicoid wound on the former to be fed forward successfully, the former itself must be of appropriate shape. The conventional former is substantially rectangular in profile with four corners which bite from inside the formed helicoid into the surface of the wires; the wire itself is tensioned, and the former is rotated and fed forward with the helicoid, guided by the spiral sleeve. The length of the indexing stroke is established by the pitch of the spiral sleeve.

Drawbacks are first encountered when crafting the links, which are sprung and thus tend to open cut when released and overhung so that the cutting tools may engage them. To enable these steps being carried out correctly, certain conditions must be maintained absolutely constant: the initial tension of the wire and the shape of the link (which must be looped with the butt-ends in close contact to permit of easy soldering), and the annealed state of alloyed metals making up the wire. Such requirements will always be difficult to meet, for obvious reasons. What is more, the link is invariably oval, and there is no possibility of its assuming any other shape.

A further drawback is encountered when the former has to withdraw in readiness to index through another turn and feed another link toward the cutting tools, and toward the tools which grip the links for joining purposes. It is not always the case that the former, directly engaging the wire, is successfully withdrawn so as to leave the wound helicoid perfectly motionless; what happens, conversely, is that the stretch of link springs apart when released and inhibits correct formation of the link, jeopardizing correct operation of the automatic machine.

Machines of the type in question are also beset by practical difficulties; the links turned out are invariably of an oval shape which permits of no modification whatever when adopting this particular system for formation of the helicoid.

The object of the invention is to eliminate the drawbacks thus described.

SUMMARY OF THE INVENTION

The invention, as claimed hereinafter, solves the problem of decoration carried out on helicoid members and/or links which may be perfectly circular, or of whatever shape, and of decorating such members while held against a stable reference surface rather than while overhung, by way of a method and apparatus wherein movement both of the helicoid members and the former which carries and feeds them forward is much simplified with respect to the prior art.

The principle advantage of the invention lies substantially in that fact that the tension of the wire, the shape of the link, and the annealed state of the wire, no longer have any great bearing on the end result, since the wire is crafted and decorated while still on the former, and breasted closely with the milled surface of the former during such operations.

A further advantage, which concerns appearance, is that the decorative effect of the finished chain is applied to the wire while still in the helicoid state.

Another advantage is that the cross section of the end part of the former may be shaped such that it becomes possible to produce a number of different link shapes, which can either be twisted subsequently or simply joined one with the next.

BRIEF DESCRIPTION OF THE DRAWINGS

The invention will now be described in detail by way of example with the aid of the accompanying drawings, in which:

FIG. 1 shows a schematic representation of apparatus according to the invention which is partly a block diagram, and partly pictorial;

FIGS. 1*a* & 1*b* are respective axial and cross sections, viewed in relation to the wire to be decorated, of means for producing a milled surface on the wire;

FIG. 2*a''* is the section through a further embodiment of the components illustrated in FIG. 2*a'*;

FIG. 4 is the perspective of a stretch of link obtainable with apparatus according to the invention.

DESCRIPTION OF THE PREFERRED EMBODIMENT

Figure 2:
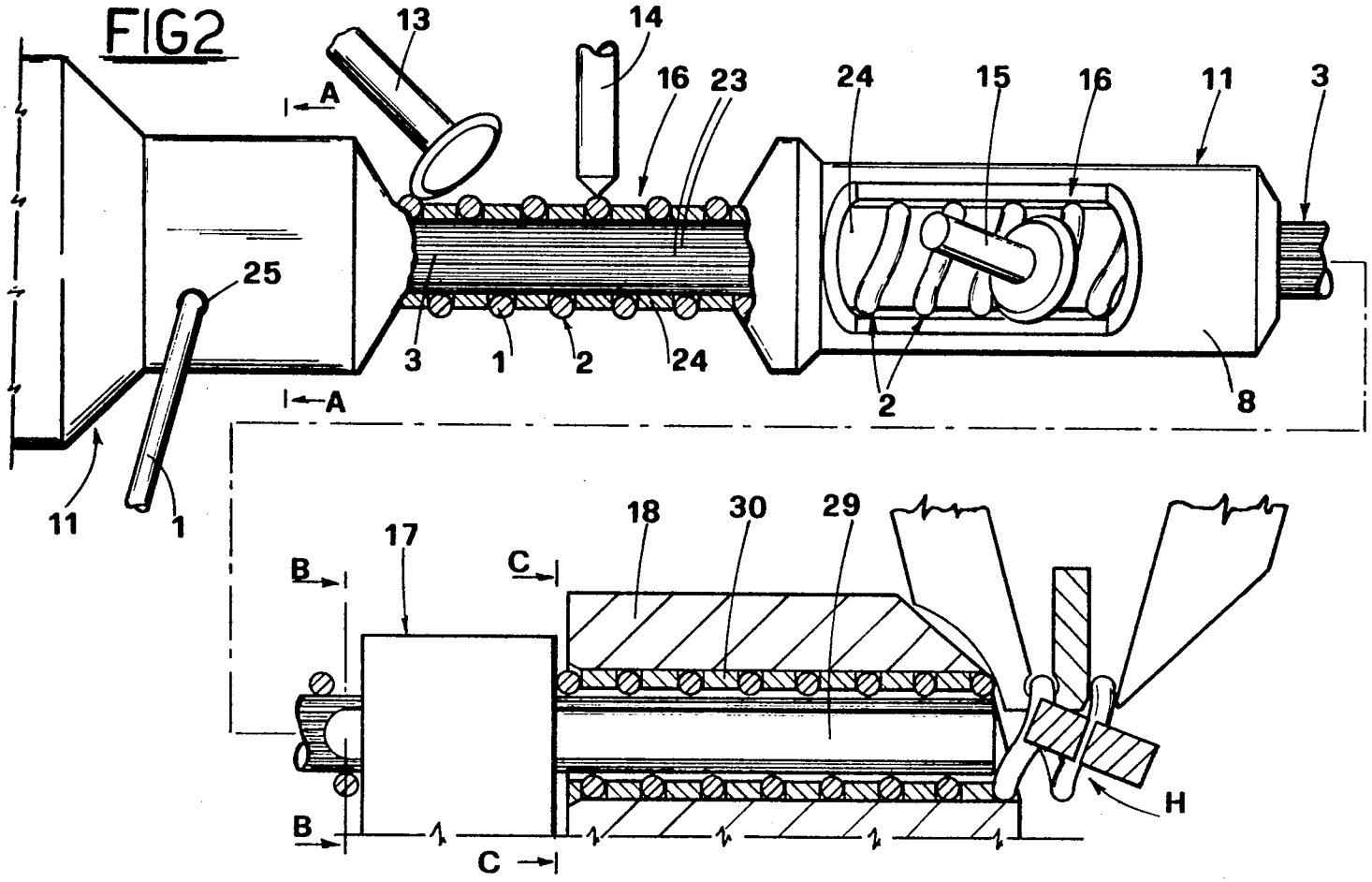
FIG. 2 is a longitudinal elevation of the essential parts of apparatus according to the invention.

With reference to the drawings, besides being illustrative of apparatus according to the invention, FIG. 1 also schematizes the method as claimed herein, which comprises the following steps:

a—infeed of a wire 1 uncoiled from an interchangeable clutch-driven supply reel;

b—straightening of the wire 1;

c—formation of two parallel opposed guide grooves 4 on and along at least one straight line generator of the wire 1;

d—milling of the wire 1 transverse to its axis and along one of its straight line generators, the wire 1 being guided by way of the grooves 4 before and after such milling;

e—winding of the wire 1 into a helicoid 2 around a former 3 having a splined profile designed to interlock with the milled surface 5 formed in the wire 1;

f—crafting and decoration of the wire 1 while still wound helicoidally around the former 3;

g—(optional) shaping of each turn of the helicoid 2 to the cross-sectional profile of the former 3;

the guiding operation of step d being introduced immediately before the winding step of point e in order to avoid twisting the wire 1, and the milled surface 5 produced on the wire 1 being angled with respect to the axis of the wire to a degree $\beta$ which is equal to the lead angle of the helicoid 2 with respect to the former 3.

h—formation of a link from the end-most turn of the helicoid 2, and connection of the link thus formed with the supervening end-most turn of the helicoid 2;

the wire 1 being fed so as to follow the lead of the helicoid 2, and the former 3 extended and retracted each time through a distance equal to the pitch of the helicoid 2.

The capital letters of the block diagram in FIG. 1 correspond to the various steps which go to make up the method according to the invention; it will be observed that FIG. 1 also illustrates a block denoted D', signifying that the wire 1 may also be guided immediately prior to the point where step e takes place.

The letters of FIG. 1 also denote means for carrying out the various steps, some of which will be common knowledge to one having skill in the art; with this in mind, only such means as constitute a part of the invention are described herein.

FIGS. 1*a* and 1*b* illustrate means for carrying out step D of the method; 9 denotes a wheel, and 10 a mount supporting the wheel. The mount 10 exhibits a hole 21, through which the wire 1 is made to pass. The hole 21 is disposed perpendicular to the axis of the wheel 9 and distanced therefrom just sufficiently to permit of producing a milled surface 5 on the wire (FIG. 3) this milled surface 5 will be so faint as to be almost invisible to the naked eye, but will be of sufficient depth for the purpose in hand. Each of the single cuts making up the milled surface 5 is angled through $\beta$ degrees relative to the axis of the wire 1, for reasons which will become apparent in due course. As FIG. 1*b* demonstrates, the hole 21 in the mount 10 exhibits two protrusions 22 which match corresponding opposed guide grooves 4, created in the wire 1 at the station denoted C by conventional means.

FIG. 2 illustrates the parts which constitute the essential novelty of apparatus according to the invention. 3 denotes a small diameter former, and 11 a spiral winding sleeve; 13, 14 and 15 are tools, 17 and 18 are further machine stages, and the assembly denoted H represents the means for carrying out step h of the method as claimed herein.

The former 3 is cylindrical, and is provided around its periphery with splines 23 which engage the milled surface 5 produced on the wire 1. The former 3 is supported through most of its length by the spiral sleeve 11, from which it projects, exhibiting one of a variety of cross-sectional shapes. FIG. 2 shows the projecting stretch in question, by way of example, embodied wtih two longitudinal opposed flutes 29 that produce the cross section illustrated in FIGS. 2*b* and 2*c*. It will become clear that this is only one of many possible shapes that the cross section of this projecting stretch of the former 3 may assume.

The former 3 is caused to extend (toward the right as viewed in FIG. 2) shfting axially and rotating at the same time, whereas in retracting the movement is purely axial.

The spiral sleeve 11 is an assembly consisting of an internal separator 24 and a casing 8. An annular element 32, located between the casing 8 and the separator 24 along the wire infeed stretch, is designed to exert radial compression on the wire; the element 32 is fashioned from hard metal whereas the casing 8 and sleeve 24 are in antifriction material, the reason for which will become clear. The separator 24 is made fast to the casing 8, and accommodates the former 3 without restraint. The casing 8 is supported by the base frame (not shown) of the apparatus and exhibits a succession of cylindrical stretches which progressively decrease in diameter toward the open end of the spiral sleeve, thereby rendering the unit both strong and lightweight. The casing 8 is provided further with a series of paired, opposed windows 16 which afford access to the wire 1 for such tools 13, 14 and 15 as are used in crafting and decoration.

Figures 2A, 2B, 2C, 3:
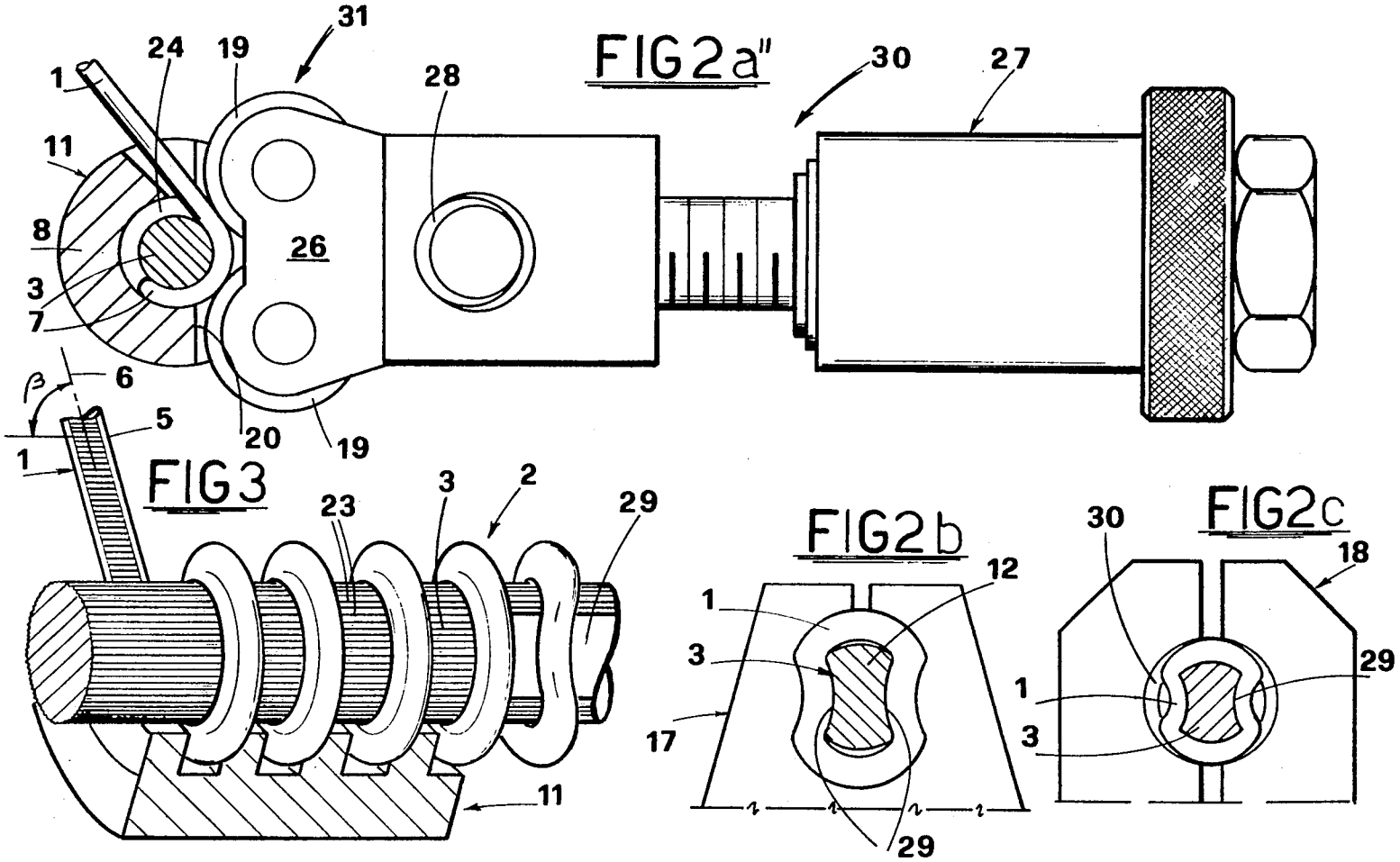
FIGS. 2*a'*, 2*b* and 2*c* are axial sections through A—A, B—B and C—C in FIG. 2.
FIG. 3 is a perspective view which illustrates the inventive step claimed for the method and apparatus according to the invention.

25 denotes an infeed hole passing through the casing 8 and the annular element 32 in alignment with a gap in the separator 24, at a point near to the base frame of the apparatus. The infeed hole 25 is disposed tangentially to the former 3 to all intents and purposes (see FIG. 2*a*'), and creates an angle $\beta$ with the axis of the former 3 which matches the angle $\beta$ created by the axis of the former 3 and the lead angle of the separator 24. In FIGS. 2 and 2*a*' the infeed hole 25 is shown directed downward, though it is clear that the direction could be otherwise, whether to satisfy construction requirements, or whatever, provided that the matching angles $\beta$ are maintained.

FIG. 2*a*' illustrates that instant in which the leading end 7 of the wire 1 fed in from a new reel is brought into engagement with the separator 24. The end 7 is tapered slightly to facilitate insertion and subsequent engagement of the wire 1 between and by the former 3 and the annular element 32. The space existing between successive turns of the separator 24 is in fact rendered slightly less than the diameter of the wire 1, by suitable embodiment of the former 3 and the annular element 32, so as to ensure that the splines 23 of the former 3 interlock correctly and firmly with the milled surface 5 of the wire 1. It will thus be appreciated that the annular element 32 must be embodied in a hard, strong material so as to urge the milled wire 1 against the similarly machined former 3 and ensure good grip, whereas the casing 8 and the separator 24, which serve simply to guide the wire 1 without distorting it, are embodied in an antifriction material that will not mark or otherwise damage the wire.

It will be observed in FIG. 3 that each of the single cuts making up the milled surface 5 is angled, in relation to the axis 6 of the wire 1, to the same degree $\beta$ as that through which the lead angle of the separator 24 is angled in relation to the axis of the former 3. The wire 1 is thus formed into a helicoid 2 when wound around the former 3 (FIG. 2) which matches the separator 24 exactly. Clearly, if the cuts making up the milled surface 5 were not angled to the appropriate degree $\beta$ then there could be no interlock between the former 3 and the wire 1.

FIG. 2*a*″ shows an alternative embodiment of the infeed system of FIG. 2*a*′; more precisely, the hole 25 is replaced by an opening 20 through which a pair of wheels 19 can be urged against the former 3. Each of the wheels 19 has a peripheral groove partly matching the shape of the wire 1, and is carried by a mounting 26 such that the grooves are angled to the same degree $\beta$ as that of the lead angle of the separator 24, in relation to the axis of the former 3. The mounting 26 also incorporates an adjustment facility which makes use of a screw 27 and an cam 28. With a system such as this, there is no need to taper the leading end 7 of the wire 1 so as to facilitate its insertion into the space in the spiral sleeve 11; all that is required is to locate the end 7 of the wire between the former 3 and the first wheel 19, then draw the wheel closer to the former by turning the screw 27, and finally, pinch the wire 1 between the first wheel 19 and the former 3 by way of the cam 28, which permits of a much finer adjustment than that produced by the screw 27. The wheels 19 perform the function of the annular element 32 in FIG. 2*a*′, which is therefore dispensed with, and the entire spiral sleeve 11 of this embodiment can be fashioned from an antifriction material.

The milled surface 5 can be produced on the wire 1 by means of components 31 as illustrated in FIGS. 1*a* and 1*b*, or by the assemblies of FIGS. 2*a*′ and 2*a*″, or indeed by the former 3 itself. The milled surface 5 can thus be produced in the wire 1 as it comes into contact gradually with the former 3; in this case, the mount 10 would not contribute to production of the milled surface, but would simply guide the wire 1 in order to avoid twisting that might jeopardize the formation of the milled surface 5, and to ensure its interlocking correctly with the splined former 3. In apparatus as illustrated in FIGS. 2 and 2*a*′, the milled surface 5 is produced on contact with the former 3, a fact which further necessitates embodiment of the annular element 32 in a hard, tough metal. In the apparatus shown in FIG. 2*a*″ however, the annular element 32 can be dispensed with since the wheels 19 are able to perform the relevant function.

Three tools are shown by way of example in FIGS. 2; 13 and 15 denote cutters, and 14 a shaping tool. Such tools might be greater or fewer in number and arranged in whatever positions, to produce the widest imaginable variety of decorative effects, of which FIG. 4 demonstrates an example.

The stage denoted 17 is a clasp mechanism (see also FIG. 2*b*), whereas 18 is a post-shaping guide (see also FIG. 2*c*); the two parts are located, first 17, then 18, along the final stretch of the former 3, which is provided with flutes 29 and extends from the open end of the spiral sleeve 11. The clasp mechanism 17 is contoured internally to match the cross-section 12 of the final stretch of the former 3, and applies a radial compression to the helicoid 2, which will already have been decorated by the tools 13, 14 and 15 in the example illustrated. The pressure stroke is rhythmical, and following such compression, the helicoid 2 of wire 1 assumes the profile shown in FIG. 2*b*; this is in fact the shape which each link of the chain will exhibit on running out from the apparatus as illustrated. Clearly, the cross section of the former 3, and therefore of the clasp mechanism 17, will vary according to the shape of each single chain link to be manufactured.

The post-shaping guide 18 is split vertically into two halves so as to permit of adjustment, and guides the helicoid 2, shaped by the clasp mechanism 17, along the former 3 toward the station denoted H. The guide 18, which exhibits a circular bore through which the former 3 is made to pass, accommodates a second separator 30 the maximum transverse dimension of which matches the maximum transverse dimension of the helicoid 2 following its being pressed by the clasp mechanism 17 into the desired shape.

The assembly of parts denoted H requires no detailed description, being common knowledge to anyone possessing ordinary skill in the art.

The former 3, invested at first with linear and rotational movement in order to advance together with the wire 1 and cause the wire 1 itself to follow the spiral path through the spiral sleeve 11, is made simply to slide axially with respect to the wire 1, on when retracting, the wire being restrained by the separator 24. Indexing of the former 3, hence of the wire 1, can be either intermittent or continuous, and the indexed length either equal to the pitch of the helicoid 2 and of the separator 24, or to a multiple thereof. Retracting movement of the former 3 relative to the wire 1 must be linear only, since the splines 23 and the flutes 29 are longitudinal, and must be allowed to slide in relation to the milled surface 5 of the wire 1 and to the post-shaping profile of the helicoid 2, respectively.

What is claimed

1. Method for the automatic decoration of helicoid members and/or links from which to fashion chain-type articles of jewelry in precious metal, and of costume jewelry, comprising the following steps:

a—feeding a wire uncoiled from an interchangeable clutch-driven supply reel;

b—straightening the wire;

c—forming at least one guide groove on and along at least one straight line generator of the wire;

d—milling the wire transverse to its axis and along one of its straight line generators to avoid subsequent twisting, guiding the wire by way of the grooves before and after such milling;

e—winding the wire into a helicoid around a small diameter former having a splined profile and interlocking the milled surface formed in the wire with the splined profile; supporting the former bilaterally to bear strains from the decoration tools;

f—crafting and decorating the wire while still wound helicoidally around the former;

g—shaping of each turn of the helicoid to the cross-sectional shape of the former;

wherein said guiding is introduced immediately before said winding in order to avoid twisting the wire, and said milling produces single cuts forming the milled surface produced on the wire which are angled in relation to the axis of the wire to a degree $\beta$ which is equal to the lead angle of the helicoid in relation to the former;

and the further step of:

h—forming a link from the end-most turn of the helicoid, and connecting the link thus formed with the supervening end-most turn of the helicoid;

wherein the feeding of the wire is regulated to follow the lead of the helicoid, and advancing and retracting the former at each such operation through a distance equal to the pitch of the helicoid takes place, the advancing of the former being accompanied by a spin movement, the retracting of the former being a straight line translation with no rotation of the former.

2. Method as in claim 1 wherein the step d of producing a milled surface on the wire is carried out simultaneously with the step e of winding the wire into a helicoid around the former.

3. Method as in claim 1 wherein there is a further step of reducing the leading end of the wire and inserting it between the splined former and an annular element which forcibly restrains the wire upon the use of a new supply reel.

4. Method as in claim 1 wherein there is a further step of engaging the leading end of the wire with the splines of the former upon the use of a new supply reel.

5. Method for the automatic decoration of helicoid members and/or links from which to fashion chain-type articles of jewelry in precious metal, and of costume jewelry, comprising the following steps:

a—feeding a wire uncoiled from an interchangeable clutch-driven supply reel;

b—straightening the wire;

c—forming at least one guide groove on and along at least one straight line generator of the wire;

d—milling the wire transverse to its axis and along one of its straight line generators to avoid subsequent twisting, guiding the wire by way of the grooves before and after such milling;

e—winding the wire into a helicoid around a small diameter former having a splined profile and interlocking the milled surface formed in the wire with the splined profile; supporting the former bilaterally to bear strains from the decoration tools;

f—crafting and decorating the wire while still wound helicoidally around the former;

and the further step of;

g—forming a link from the end-most turn of the helicoid, and connecting the link thus formed with the supervening end-most turn of the helicoid;

wherein the feeding of the wire is regulated to follow the lead of the helicoid, and advancing and retracting the former at each such operation through a distance equal to the pitch of the helicoid takes place, the advancing of the former being accompanied by a spin movement, the retracting of the former being a straight line translation with no rotation of the former.

* * * * *